US006676086B1

(12) United States Patent
Chang

(10) Patent No.: US 6,676,086 B1
(45) Date of Patent: Jan. 13, 2004

(54) TANDEM KITE DEVICE

(76) Inventor: Chin-Chuan Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/285,878

(22) Filed: Oct. 25, 2002

(51) Int. Cl.[7] ..... B64C 31/06
(52) U.S. Cl. ..... 244/153 R
(58) Field of Search ..... 244/153 R, 154, 244/155 R, 153 A

(56) References Cited

U.S. PATENT DOCUMENTS 2,788,945 A * 4/1957 Bedford ..... 244/153 R
3,494,578 A * 2/1970 Cureton ..... 244/153 R
3,954,235 A * 5/1976 Powell ..... 244/153 R
4,377,265 A * 3/1983 Takami et al. ..... 244/153 R

* cited by examiner

*Primary Examiner*—Peter M. Poon
*Assistant Examiner*—Timothy D. Collins

(57) ABSTRACT

A tandem kite device has a head sheet, a first spine, a pair of first spars, a front limb sheet, a second spine, a second spar, at least a torso sheet, a third spine, a third spar, a rear limb sheet, a fourth spine, a fourth spar, a first decoration rod, a second decoration rod, and a third decoration rod. A flying line passes through the head sheet, the front limb sheet, the torso sheet, and the rear limb sheet. The first spine and the first spars are disposed on the head sheet. The first decoration rod, the second spine, and the second spar are disposed on the front limb sheet. The second decoration rod, the third spine, and the third spar are disposed on the torso sheet. The third decoration rod, the fourth spine, and the fourth spar are disposed on the rear limb sheet.

4 Claims, 6 Drawing Sheets

TANDEM KITE DEVICE

BACKGROUND OF THE INVENTION

The present invention relates to a kite. More particularly, the present invention relates to a tandem kite device which is easily detached.

A conventional kite has a spine adhered on a cover sheet. A tail band is connected to the spine. However, the conventional kite cannot be detached.

SUMMARY OF THE INVENTION

An object of the present invention is to provide a tandem kite device which has a three dimensional configuration while the tandem kite device is flying.

Another object of the present invention is to provide a tandem kite device which is easily detached.

Accordingly, a tandem kite device comprises a head sheet, a first spine, a pair of first spars, a front limb sheet, a second spine, a second spar, at least a torso sheet, a third spine, a third spar, a rear limb sheet, a fourth spine, a fourth spar, a first decoration rod, a second decoration rod, and a third decoration rod. A flying line passes through the head sheet, the front limb sheet, the torso sheet, and the rear limb sheet. The head sheet has a plurality of round holes, and a plurality of first sockets to receive the first spine and the first spars. The front limb sheet has a plurality of circular holes, a plurality of second sockets to receive the second spine and the second spar, and a pair of first positioning seats to receive the first decoration rod. The torso sheet has a plurality of round apertures, a plurality of third sockets to receive the third spine and the third spar, and a pair of second positioning seats to receive the second decoration rod. The rear limb sheet has a plurality of circular holes, a plurality of fourth sockets to receive the fourth spine and the fourth spar, and a pair of third positioning seats to receive the third decoration rod.

DETAILED DESCRIPTION OF THE INVENTION

Figure 1:
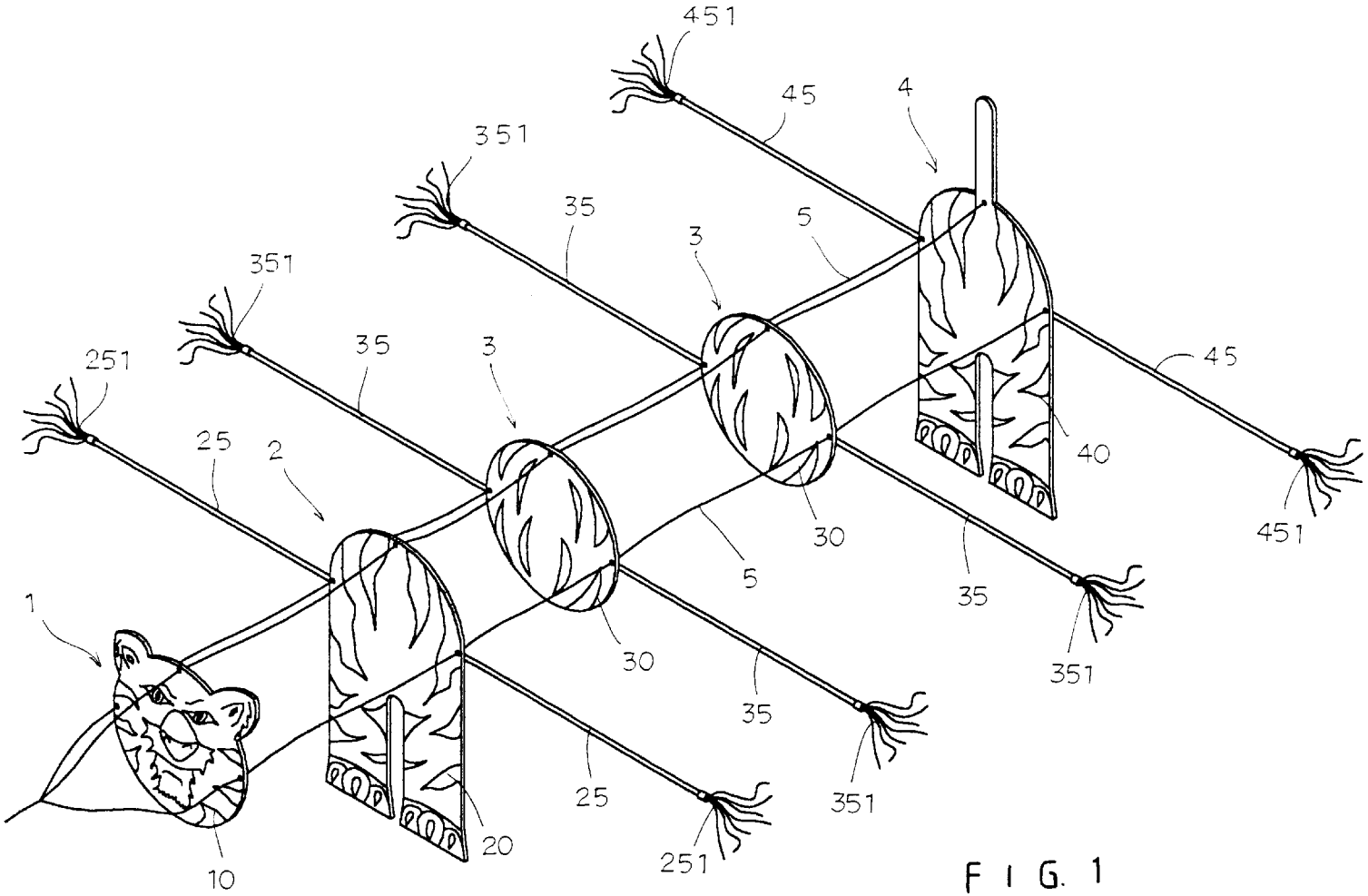
FIG. 1 is a perspective assembly view of a tandem kite device of a preferred embodiment in accordance with the present invention.
Figure 2:
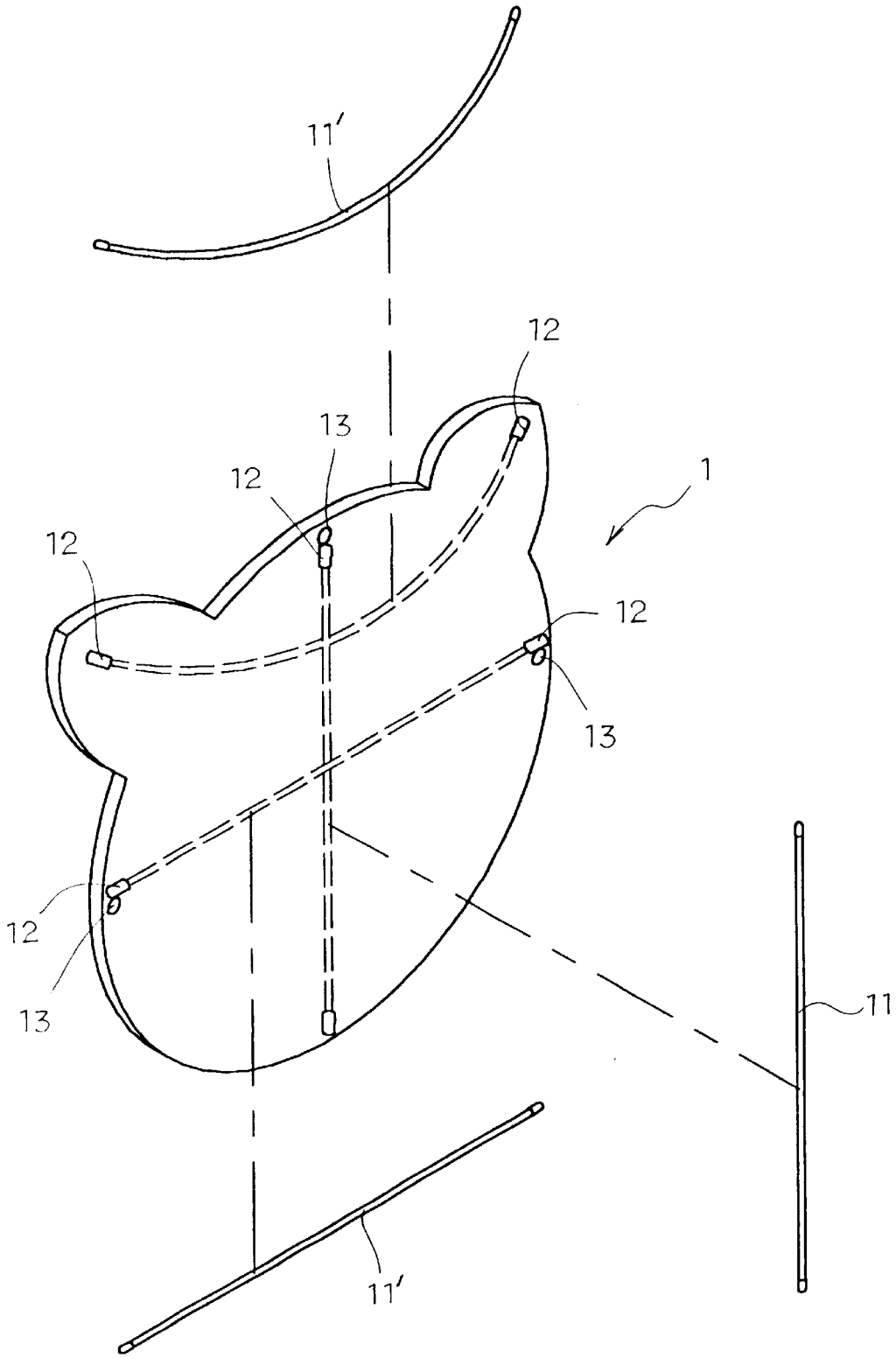
FIG. 2 is a perspective exploded view of a head sheet, a first spine, and a pair of first spars of a preferred embodiment in accordance with the present invention.
Figure 3:
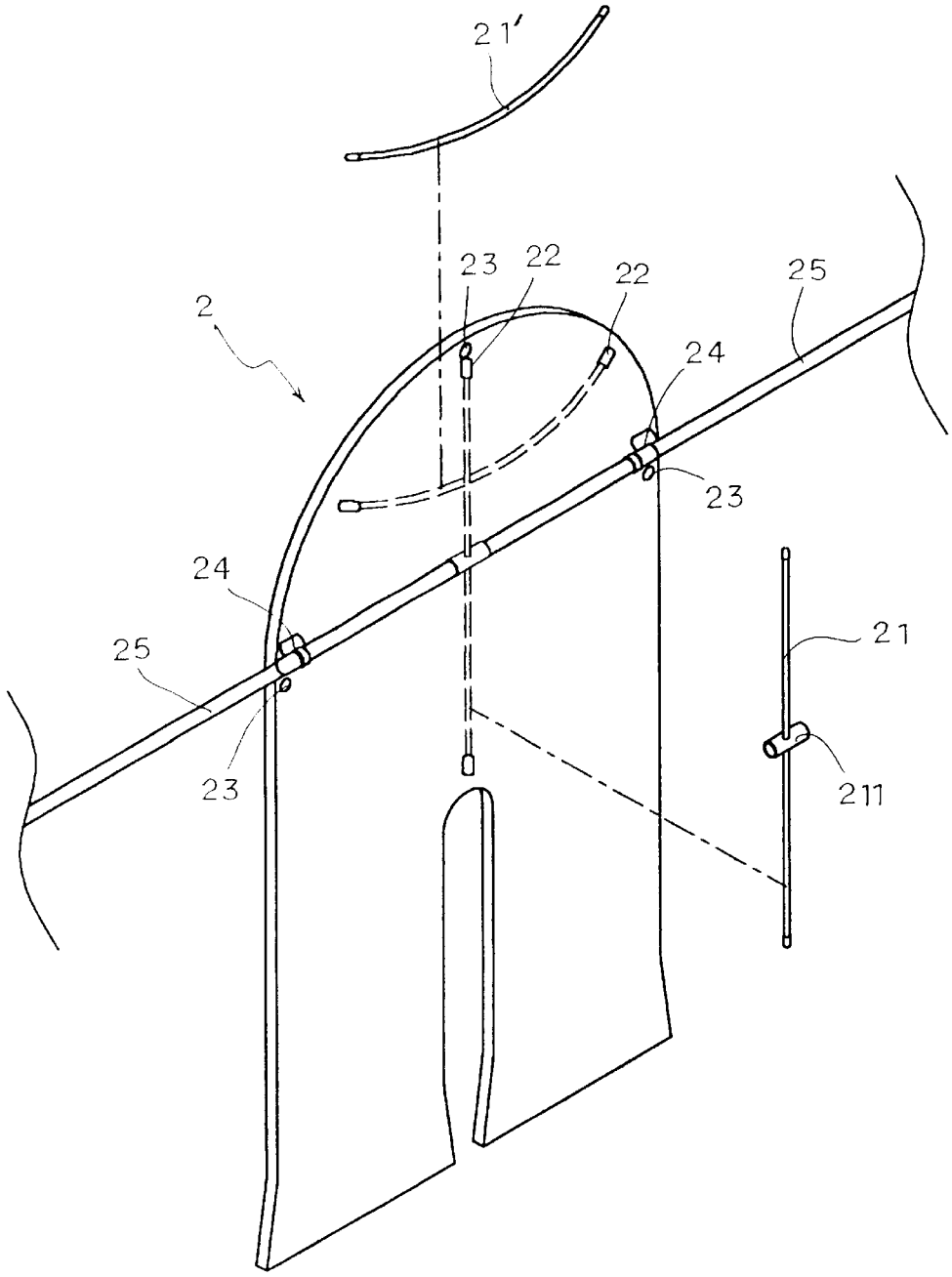
FIG. 3 is a perspective exploded view of a front limb sheet, a second spine, and a second spar of a preferred embodiment in accordance with the present invention.
Figure 4:
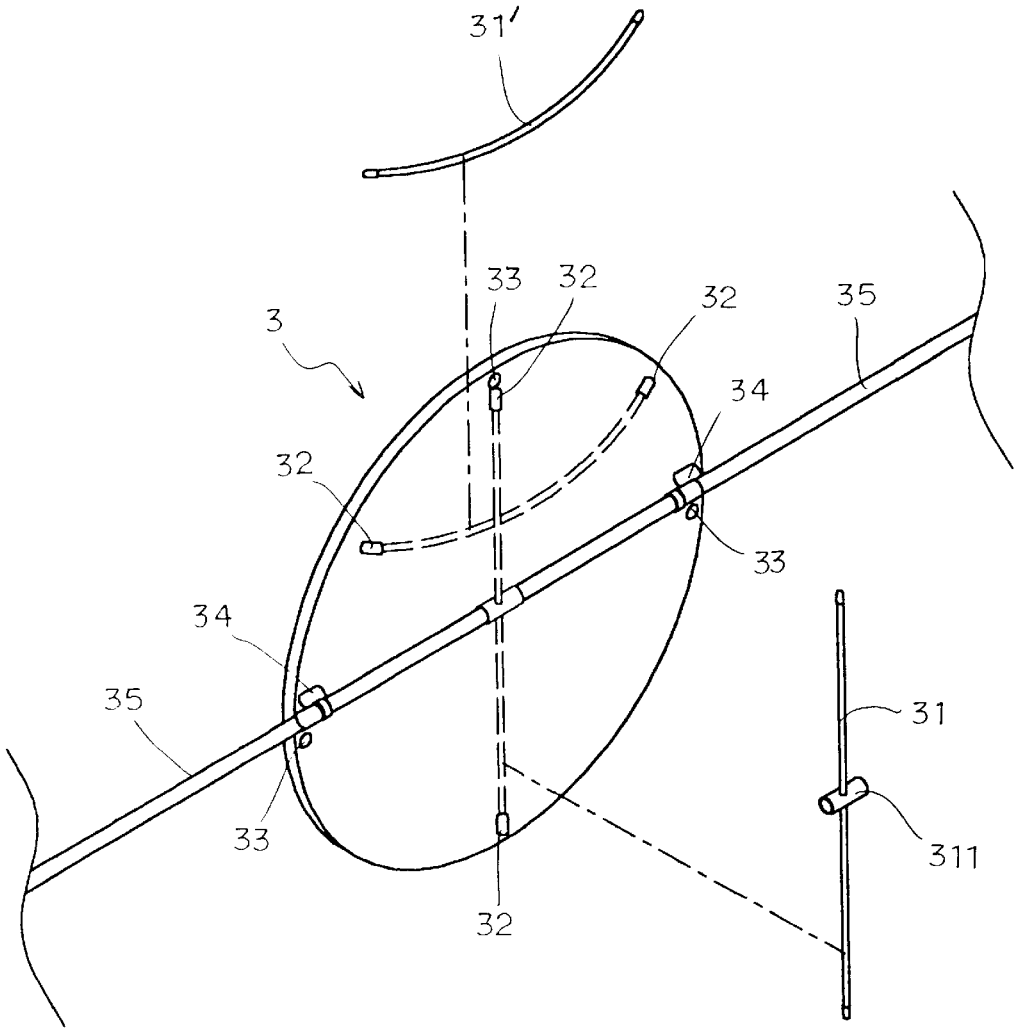
FIG. 4 is a perspective exploded view of a torso sheet, a third spine, and a third spar of a preferred embodiment in accordance with the present invention.
Figure 5:
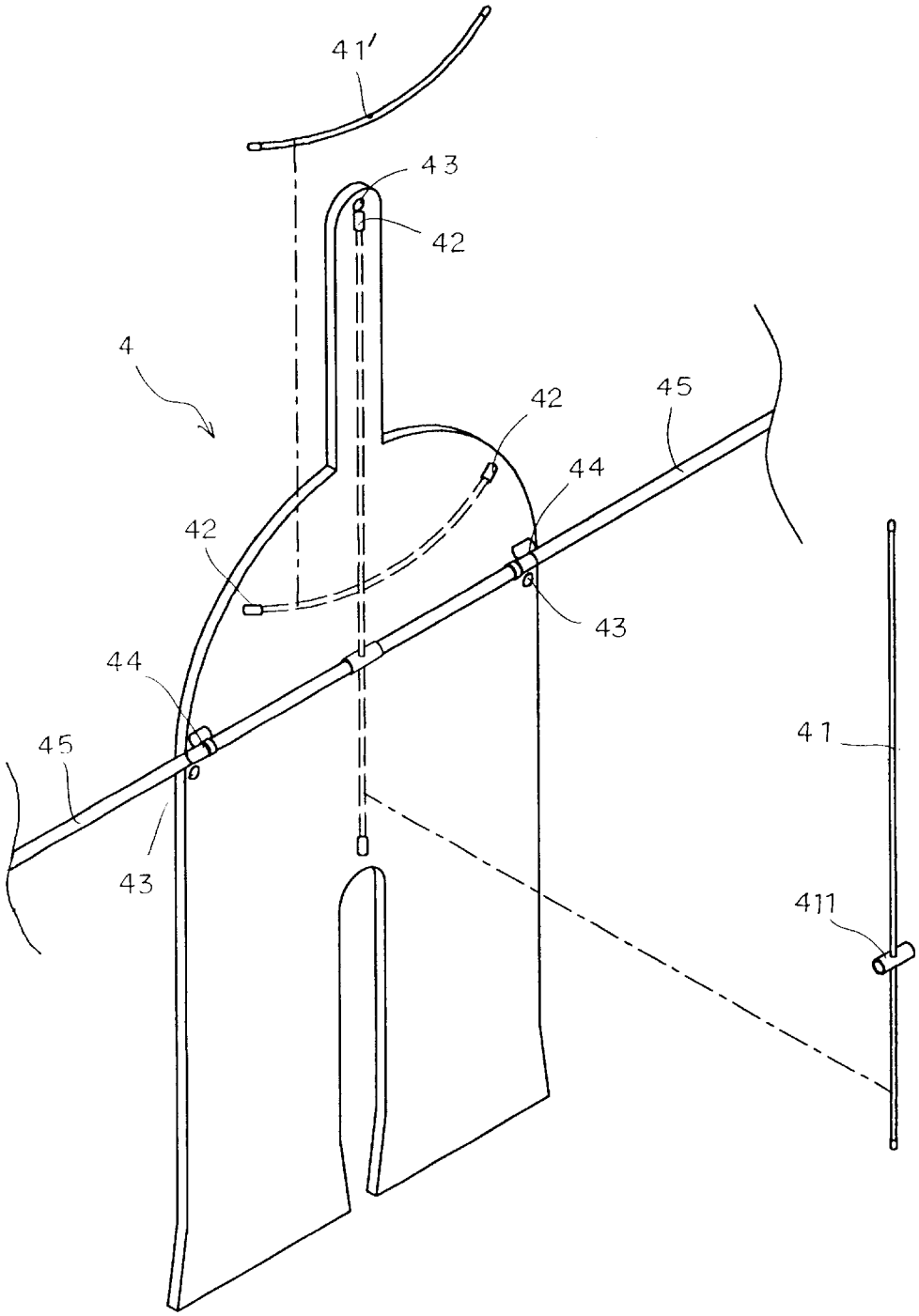
FIG. 5 is a perspective exploded view of a rear limb sheet, a fourth spine, and a fourth spar of a preferred embodiment in accordance with the present invention.
Figure 6:
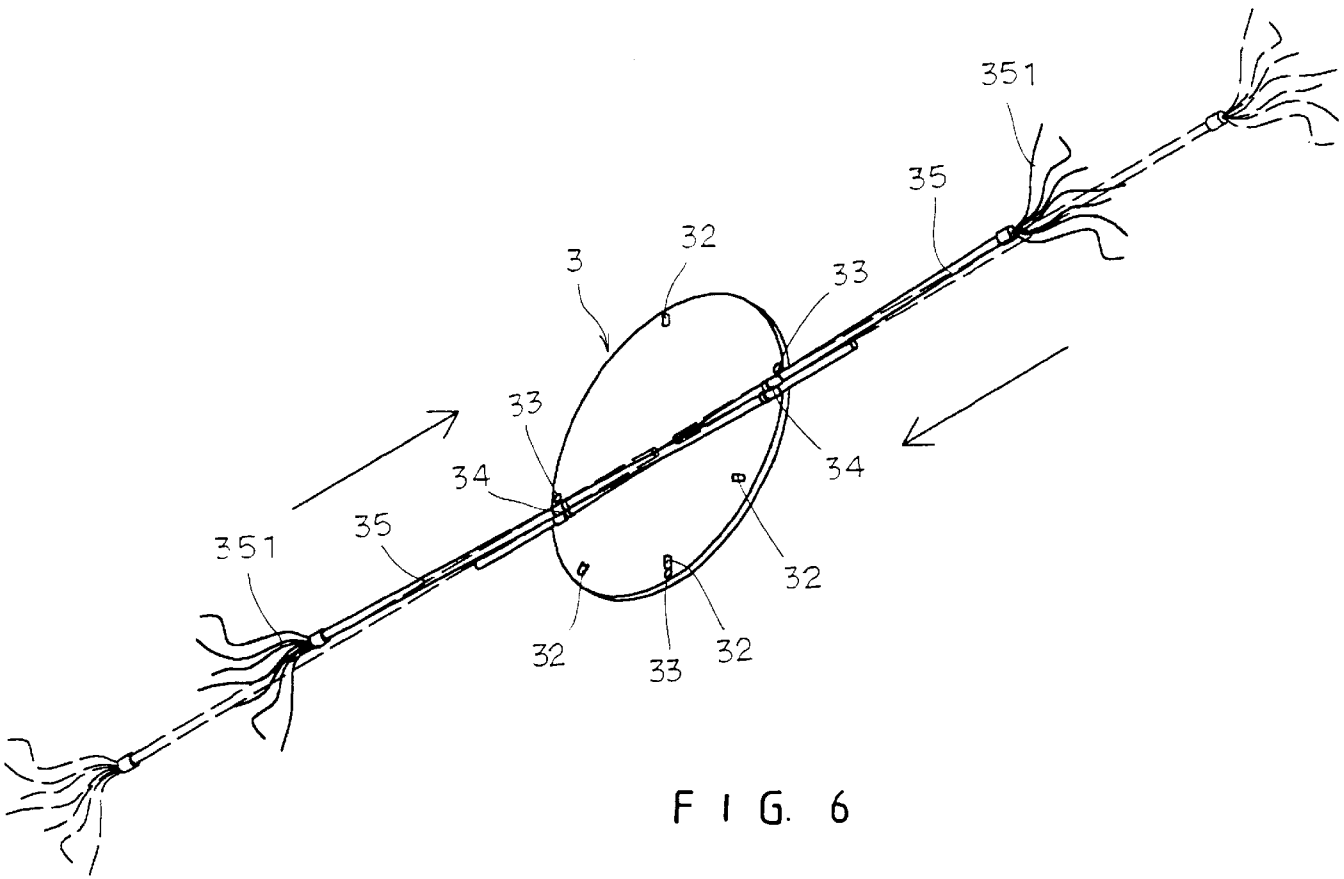
FIG. 6 is a schematic view illustrating a tandem kite device of a preferred embodiment is detached.

Referring to FIGS. 1 to 6, a tandem kite device comprises a head sheet 1, a first spine 11, a pair of first spars 11', a front limb sheet 2, a second spine 21, a second spar 21', at least a torso sheet 3, a third spine 31, a third spar 31', a rear limb sheet 4, a fourth spine 41, a fourth spar 41', a first decoration rod 25, a second decoration rod 35, and a third decoration rod 45.

A flying line 5 passes through the head sheet 1, the front limb sheet 2, the torso sheet 3, and the rear limb sheet 4.

The first spine 11 and the first spars 11' are disposed on the head sheet 1.

The first decoration rod 25, the second spine 21, and the second spar 21' are disposed on the front limb sheet 2.

The second decoration rod 35, the third spine 31, and the third spar 31' are disposed on the torso sheet 3.

The third decoration rod 45, the fourth spine 41, and the fourth spar 41' are disposed on the rear limb sheet 4.

The head sheet 1 has a plurality of round holes 13, and a plurality of first sockets 12 to receive the first spine 11 and the first spars 11'.

The front limb sheet 2 has a plurality of circular holes 23, a plurality of second sockets 22 to receive the second spine 21 and the second spar 21', and a pair of first positioning seats 24 to receive the first decoration rod 25.

The torso sheet 3 has a plurality of round apertures 33, a plurality of third sockets 32 to receive the third spine 31 and the third spar 31', and a pair of second positioning seats 34 to receive the second decoration rod 35.

The rear limb sheet 4 has a plurality of circular holes 43, a plurality of fourth sockets 42 to receive the fourth spine 41 and the fourth spar 41', and a pair of third positioning seats 44 to receive the third decoration rod 45.

The second spine 21 is inserted through a first collar 211.

The third spine 31 is inserted through a second collar 311.

The fourth spine 41 is inserted through a third collar 411.

The first decoration rod 25 has a pair of first end tassels 251.

The second decoration rod 35 has a pair of second end tassels 351.

The third decoration rod 45 has a pair of third end tassels 451.

The head sheet 1 is made of a fabric such as a canvas and a waterproof fabric.

The front limb sheet 2 is made of a fabric such as a canvas and a waterproof fabric.

The torso sheet 3 is made of a fabric such as a canvas and a waterproof fabric.

The rear limb sheet 4 is made of a fabric such as a canvas and a waterproof fabric.

The head sheet 1 has a head pattern 10.

The front limb sheet 2 has a front limb pattern 20.

The torso sheet 3 has a torso pattern 30.

The rear limb sheet 4 has a rear limb pattern 40.

The present invention has the following advantages. The tandem kite device has a three dimensional configuration while the tandem kite device is flying, and the tandem kite device which is easily detached.

The present invention is not limited to the above embodiments but various modification thereof may be made. Furthermore, various changes in form and detail may be made without departing from the scope of the present invention.

I claim:

1. A tandem kite device comprises:

a head sheet, a first spine, a pair of first spars, a front limb sheet, a second spine, a second spar, at least a torso sheet, a third spine, a third spar, a rear limb sheet, a fourth spine, a fourth spar, a first decoration rod, a second decoration rod, and a third decoration rod, a flying line passing through the head sheet, the front limb sheet, the torso sheet, and the rear limb sheet, the head sheet having a plurality of round holes, and a plurality of first sockets to receive the first spine and the first spars, the front limb sheet having a plurality of circular holes, a plurality of second sockets to receive the second spine and the second spar, and a pair of first positioning seats to receive the first decoration rod, the torso sheet having a plurality of round apertures, a plurality of third sockets to receive the third spine and the third spar, and a pair of second positioning seats to receive the second decoration rod, and the rear limb sheet having a plurality of circular holes, a plurality of fourth sockets to receive the fourth spine and the fourth spar, and a pair of third positioning seats to receive the third decoration rod.

2. The tandem kite device as claimed in claim 1, wherein the first decoration rod has a pair of first end tassels, the second decoration rod has a pair of second end tassels, and the third decoration rod has a pair of third end tassels.

3. The tandem kite device as claimed in claim 1, wherein the head sheet is made of a fabric such as a canvas and a waterproof fabric, the front limb sheet is made of a fabric such as a canvas and a waterproof fabric, the torso sheet is made of a fabric such as a canvas and a waterproof fabric, and the rear limb sheet is made of a fabric such as a canvas and a waterproof fabric.

4. The tandem kite device as claimed in claim 1, wherein the head sheet has a head pattern, the front limb sheet has a front limb pattern, the torso sheet has a torso pattern, and the rear limb sheet has a rear limb pattern.

* * * * *